US010882307B2

(12) United States Patent
Patzelt et al.

(10) Patent No.: US 10,882,307 B2
(45) Date of Patent: Jan. 5, 2021

(54) SHEET-FED PRINTING PRESS

(71) Applicant: KOENIG & BAUER AG, Würzburg (DE)

(72) Inventors: Bernd Patzelt, Meißen (DE); Ralf Sammeck, Radebeul (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 16/484,554

(22) PCT Filed: Oct. 1, 2018

(86) PCT No.: PCT/EP2018/076654

§ 371 (c)(1),
(2) Date: Aug. 8, 2019

(87) PCT Pub. No.: WO2019/072612

PCT Pub. Date: Apr. 18, 2019

(65) Prior Publication Data

US 2020/0223218 A1 Jul. 16, 2020

(30) Foreign Application Priority Data

Oct. 13, 2017 (DE) ..... 10 2017 218 399
Oct. 13, 2017 (DE) ..... 10 2017 218 401
Oct. 13, 2017 (DE) ..... 10 2017 218 403

(51) Int. Cl.
*B41F 21/10* (2006.01)
*B41F 21/04* (2006.01)

(52) U.S. Cl.
CPC ..... *B41F 21/04* (2013.01)

(58) Field of Classification Search
CPC ..... B41F 21/106
(Continued)

(56) References Cited

U.S. PATENT DOCUMENTS 4,015,522 A * 4/1977 Preuss ..... B41F 21/08 101/183
4,610,446 A * 9/1986 Ide ..... G03G 15/234 271/186

(Continued)

FOREIGN PATENT DOCUMENTS

DE 19757163 A1 6/1999
DE 19819491 C1 9/1999

(Continued)

OTHER PUBLICATIONS

International Search Report of PCT/EP2018/076654 dated Dec. 20, 2018.

*Primary Examiner* — Anthony H Nguyen
(74) *Attorney, Agent, or Firm* — Mattingly & Malur, PC

(57) ABSTRACT

The invention relates to a sheet-fed printing press having a feeder, a delivery, and at least one sheet guiding cylinder, which is arranged between the feeder and the delivery, has a gripper system, and is assigned a digital printing system and a first sheet guiding system that removes sheets from the sheet guiding cylinder. The object of the invention is to devise a sheet-fed printing press that can be used in a more variable fashion, and with which a particularly wide spectrum of different products can be produced. According to the invention, the object is attained in that the first sheet guiding system (12) is configured for selectively transferring the sheets to a second sheet guiding system (8), which transfers the sheets to the sheet guiding cylinder (3), or for transferring said sheets to the delivery (11), wherein the second sheet guiding system (8) is configured as a perfecting system (8) and can be switched between an operating mode in which it feeds the sheets in a reversed position to the sheet guiding (Continued)

cylinder (3) and an operating mode in which it feeds the sheets in a non-reversed position to the sheet guiding cylinder.

14 Claims, 1 Drawing Sheet

(58) Field of Classification Search
USPC ..... 101/246
See application file for complete search history.

(56) References Cited

U.S. PATENT DOCUMENTS

| | | | | |
|---|---|---|---|---|
| 5,479,856 | A * | 1/1996 | Wirz | B41F 7/025 101/177 |
| 6,027,270 | A | 2/2000 | Greive | |
| 6,789,475 | B2 * | 9/2004 | Hesterman | B41F 7/00 101/171 |
| 7,331,289 | B2 | 2/2008 | Albrecht et al. | |
| 9,090,080 | B2 | 7/2015 | Sugaya et al. | |
| 9,764,571 | B2 | 9/2017 | Mueller et al. | |
| 10,166,783 | B2 | 1/2019 | Sugaya et al. | |
| 2002/0000166 | A1 * | 1/2002 | Nakamura | B41F 21/106 101/230 |
| 2002/0152902 | A1 | 10/2002 | Schwitzky | |
| 2004/0049578 | A1 | 3/2004 | Ohara | |
| 2012/0098880 | A1 | 4/2012 | Izumi et al. | |
| 2013/0276652 | A1 * | 10/2013 | Murakami | B41F 21/108 101/246 |
| 2015/0042736 | A1 * | 2/2015 | Landa | B41J 2/0057 347/103 |
| 2016/0200097 | A1 * | 7/2016 | Shmaiser | B41J 2/0057 347/102 |
| 2016/0279950 | A1 | 9/2016 | Sugaya et al. | |
| 2018/0141346 | A1 | 5/2018 | Sugaya et al. | |

FOREIGN PATENT DOCUMENTS

| | | | |
|---|---|---|---|
| DE | 102012017436 | A1 | 3/2014 |
| DE | 102015216728 | A1 | 3/2016 |
| DE | 102016200652 | A1 | 8/2016 |
| DE | 102016202124 | A1 | 9/2016 |
| DE | 102016223226 | A1 | 5/2017 |
| EP | 1541350 | A1 | 6/2005 |
| EP | 2703161 | A2 | 3/2014 |
| EP | 2845733 | A1 | 3/2015 |
| EP | 3016365 | A1 | 5/2016 |
| GB | 2336837 | B | 8/2000 |
| JP | 2014-177314 | A | 9/2014 |
| JP | 2015-081197 | A | 4/2015 |
| WO | 2001/08886 | A2 | 2/2001 |
| WO | 2015/060060 | A1 | 4/2015 |
| WO | 2016/181914 | A1 | 11/2016 |

* cited by examiner

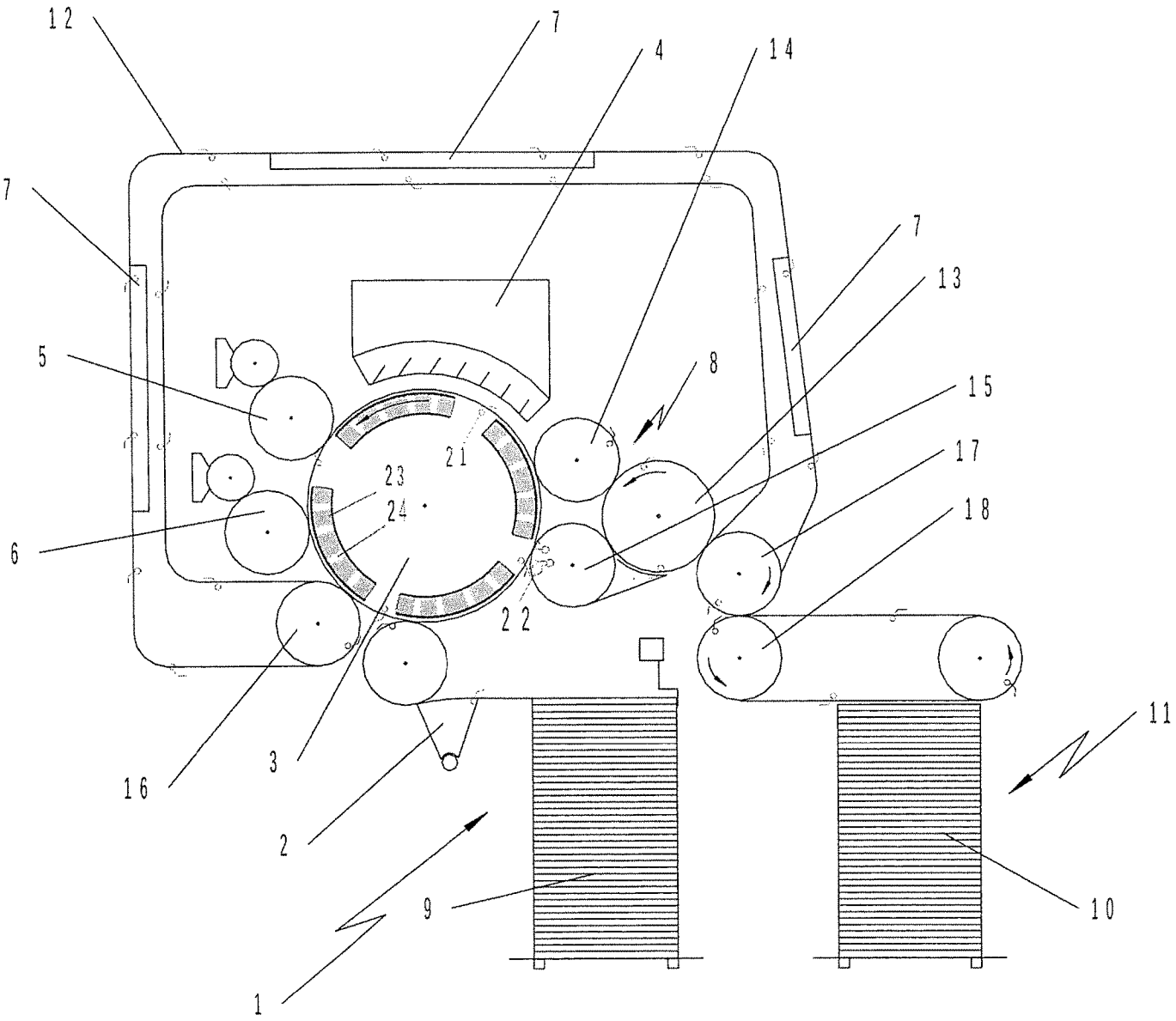
1
2
3
4
5
6
7
7
8
9
10
11
12
13
14
15
16
17
18
21
22
23
24

SHEET-FED PRINTING PRESS

CROSS REFERENCE TO RELATED APPLICATIONS

This application is the U.S. National Stage, Under 35 U.S.C. § 371, of PCT/EP2018/076654, filed Oct. 1, 2018; published as WO 2019/072612 A1 on Apr. 18, 2019 and claiming priority to DE 10 2017 218 399.3, filed Oct. 13, 2017, to DE 10 2017 281. 401.9, filed Oct. 13, 2017, and to DE 10 2017 218 403.5, also filed Oct. 13, 2017, the disclosures of which are incorporated herein in their entireties by reference.

FIELD OF THE INVENTION

The present invention relates to a sheet-fed printing press having a feeder, a delivery, and at least one sheet guiding cylinder, which is arranged between the feeder and the delivery, which at least one sheet guiding cylinder has a gripper system, and which is assigned a digital printing system, the printing press also having a first sheet guiding system that removes sheets from the at least one sheet guiding cylinder.

BACKGROUND OF THE INVENTION

From DE 10 2015 216728 A1, a device for feeding sheets which is part of a sheet-fed rotary printing press is known. The sheet-fed rotary printing press comprises an inkjet printing unit and a sheet guiding cylinder, referred to as an inkjet cylinder, to which the inkjet printing unit is assigned. On the inkjet cylinder, sheets that have been separated from a pile by a feeder unit and fed to the inkjet cylinder via two transfer drums are printed. The sheet-fed printing press further comprises a transfer drum, which removes a respective sheet from the inkjet cylinder and transfers it via additional transport elements to a delivery. The transfer drum can also be operated as a storage drum, in which case it feeds a sheet that has been printed on one side to a perfecting drum, which turns the sheet over and feeds it via additional transport elements back to the inkjet cylinder for printing of the unprinted side of the sheet. A repeated printing of one and the same side of a sheet and a priming step prior to printing are not possible in a single pass through the press.

DE 10 2016 202124 A1 discloses a duplex digital printing press in an inline configuration of modular construction for processing sheets, having a sheet feeder module, a printing module, and a sheet delivery module. Said duplex digital printing press is equipped with a sheet return, located between the sheet feeder module and the sheet delivery module, with which sheets that have been printed on one side by print heads can be fed back to said print heads. In the area of the print heads, the sheets are transported in a single plane by means of conveyor belts. In the transport path of the sheet return, a reversing pocket is located, which turns the returned sheets over to enable printing of the second side of the sheets. With the device known from DE 10 2016 202124 A1, a repeated printing of one and the same side of a sheet and a priming step prior to printing also are not possible in a single pass through the press.

Known from DE 197 57163 A1 is a sheet-fed printing press having a plurality of stations arranged in a row, including a feeder, a digital printing couple, a post-processing unit, and a delivery. The digital printing couple comprises a digital printing unit configured as an inkjet printer, for example, which is associated with a conveyor belt and which prints a sheet that has just been transported on the conveyor belt. Between the printing couple and the delivery, a common sheet transport path is formed, which is traversed by every sheet.

The sheet-fed printing press has a sheet diverter, with which sheets can be selectively directed along a return transport path into a sample sheet delivery or into a reversing pocket. A sheet that has been fed into the reversing pocket is conveyed back onto the conveyor belt with the back side of said sheet facing upward, to allow the back side to be printed.

DE 10 2012 017436 A1 describes a duplex printing press having a feeder, a delivery, and at least two printing couples. Each printing couple prints in one color and has a double-circumference blanket cylinder that bears the printing image, a device for generating the printing image digitally, e.g., an inkjet head, a first dryer, and a second dryer. Each blanket cylinder cooperates with a triple-circumference printing cylinder, which has three rows of grippers and on which the sheet receives the printing image from the blanket cylinder. Each of the devices for generating the printing image digitally is associated with the blanket cylinder. Between the printing cylinders of the printing couples, two transfer drums are arranged in parallel in each case. The sheets are conveyed by the transfer drums between the printing cylinders, and are transferred such that they move from the feeder in the direction of the delivery or in the opposite direction, depending upon the operating mode. The printing cylinder of the last printing couple may have a perfecting system, which turns sheets that have been printed on one side in the last printing couple over, and feeds them in this reversed position to the last printing cylinder for printing on the reverse side or for transfer to the printing cylinder of a printing couple upstream.

In the devices known from DE 197 57163 A1 and DE 10 2012 017436 A1, a repeated printing of one and the same side of a sheet and a priming step prior to printing are not possible in a single pass through the press.

SUMMARY OF THE INVENTION

The object of the present invention is to devise a sheet-fed printing press that can be used in a more variable fashion, and with which a particularly wide spectrum of different products can be produced.

According to the present invention, the object is attained by the provision of a sheet-fed printing press. The sheet-fed printing press includes a feeder, a delivery, and at least one sheet guiding cylinder, which is located between the feeder and the delivery. The sheet-fed printing press also has at least one gripper system, and is assigned to a digital printing system. A first sheet guiding system is also provided for removing sheets from the sheet guiding cylinder. The first sheet guiding system is configured for selectively transferring the sheets to a second sheet guiding system which then transfers the sheets back to the sheet guiding cylinder, or which transfers the sheets to the delivery. The first sheet guiding system may encompass the sheet guiding cylinder in a circumferential area that is greater than a 180 degrees, and may be configured either as a chain conveyer system or as a belt conveyer system. At least one dryer, configured as one of an infrared dryer and as a thermal air dryer, is assigned to the chain conveyor system or to the belt conveyor system. The second sheet guiding system is configured as a perfecting system and can be switched between a first operating mode, in which it feeds the sheets, in a reversed position, to the sheet guiding cylinder, and a second operating mode, in which it feeds the sheets, in a non-reversed position to the sheet guiding cylinder. The perfecting cylinder may also have a first transfer cylinder which, in one operating mode, transfers sheets to a second transfer cylinder, and in another operating mode, transfers sheets to a perfecting drum.

BRIEF DESCRIPTION OF THE DRAWINGS

The sole drawing FIGURE depicts a sheet-fed printing press.

DESCRIPTION OF THE PREFERRED EMBODIMENT

The sheet-fed printing press has a feeder 1, a delivery 11, and at least one sheet guiding cylinder 3 located between the feeder 1 and the delivery 11.

The feeder 1 can be configured in a manner known per se as a sheet feeder, in particular as a leading edge separator or as a trailing edge separator. A configuration of the sheet feeder as a reel-to-sheet feeder, with a cross cutter, is likewise possible. The feeder 1 serves to separate sheets from a pile, and feeds the separated sheets directly or via an interposed acceleration system, in particular a rocker system 2, and/or a sheet transport system, in particular a drum, to the at least one sheet guiding cylinder 3. For holding the sheets, the feeder 1 preferably has a pile board, which is suspended from chains and can be displaced vertically via a pile lifting drive, and on which a pile carrier, in particular in the form of a pallet, can be positioned. The pile carrier can accommodate one pile of sheets that are printed on one side, are partially printed, or are unprinted. The at least one sheet guiding cylinder 3 may be configured as a single-circumference cylinder and having a gripper system 21, or as a multiple-circumference cylinder. The multiple-circumference configuration may, in particular, involve a double-circumference cylinder with two gripper systems 21, or a triple-circumference cylinder with three gripper systems 21, or a quadruple-circumference cylinder with four gripper systems 21. A single gripper system, multiple gripper systems, or all gripper systems may be configured as clamping grippers or as suction grippers. Preferably, at least one such gripper system 21 is provided for securing the leading edges of the sheets. At least one holding system 23 for securing the sheets is formed in a region of the at least one sheet guiding cylinder 3 spaced apart from the leading edges of those sheets. If multiple gripper systems 21 for securing the leading edges of the sheets are provided on the at least one sheet guiding cylinder 3, then corresponding to each gripper system for securing the leading edges of the sheets, the holding system 23 for securing those sheets can also be formed in a region of the sheet guiding cylinder 3 that is spaced apart from the leading edges of the sheets.

The one holding system 23, or each holding system 23, may be formed by openings 24 to which suction air can be applied, such openings 24 being formed in a respective sheet guiding surface of the at least one sheet guiding cylinder 3. The sheet guiding cylinder 3 preferably has an even number of gripper systems for securing the leading edges of the sheets. A lateral region of the sheet guiding cylinder 3, configured as a sheet guiding surface, can adjoin each gripper system 21, with at least one such sheet guiding surface being closed and at least one sheet guiding surface having openings 24 to which suction air can be applied.

The arrangement of differently configured and alternatingly arranged sheet guiding surfaces, also referred to as sheet-guiding saddles, on a sheet-guiding cylinder 3 sized with an even-numbered multiple circumference, enables the requirements for finish-coating (full-surface counterpressure) and the requirements for inkjet printing (printing substrate guidance on the cylinder jacket, held from the inside by suction forces, adhesive forces, and/or tensile forces) to be optimally met.

A digital printing system 4 and a first sheet guiding system 12, which removes sheets from the sheet guiding cylinder 3, are preferably assigned to the sheet guiding cylinder 3. The digital printing system 4 is preferably configured as a pixel-addressable printing system, in particular as a laser printing system or as an inkjet printing system.

The first sheet guiding system 12 can be configured as a chain conveyor system or as a belt conveyor system, and can have rear and front deflecting wheels 16, 17 or sprockets 16, 17 with circulating chains or belts. On the chains, gripper devices are preferably arranged, which circulate with the chains and which are also referred to as gripper bars. In place of the chains, suction belts may also be provided, on which the sheets to be transported are held under the action of applied vacuum pressure. For guiding the chains or the suction belts, deflecting wheels 16, 17 and/or guide tracks may be provided. The guide tracks are preferably associated with side frame parts or frame walls. The first sheet guiding system 12 is preferably guided such that it encompasses the sheet guiding cylinder 3 in a circumferential area (circumferential angle) around the sheet guiding cylinder 3 that is greater than 180 degrees, in particular greater than 270 degrees. In other words, the sheet guiding cylinder 3 is wrapped by a linear sheet guiding path formed by the first sheet guiding system 12.

The first sheet guiding system 12 is preferably configured for selectively transferring the sheets to a second sheet guiding system 8, which transfers the sheets that it removes from the sheet guiding cylinder 3 back to the sheet guiding cylinder 3, or for transferring those sheets to the delivery 11. In a first operating mode, all the sheets, in a sequence of sheets, can be transferred to the delivery 11. In a second operating mode, all the sheets, in a sequence of sheets, can be transferred to the second sheet guiding system 8. In a third operating mode, the sheets, in a sequence of sheets, can be transferred alternatingly to the delivery 11 or to the second sheet guiding system 8, according to a specified timing cycle. The second sheet guiding system 8 is preferably configured as a perfecting system 8 and can be switched between an operating mode, in which it feeds the sheets in a reversed position to the sheet guiding cylinder 3, and an operating mode in which it feeds the sheets in a non-reversed position to the sheet guiding cylinder 3.

According to a first embodiment, the second sheet guiding system 8, configured as a perfecting system, can have a first transfer cylinder 13, which, in a recto operating mode, transfers sheets to a second transfer cylinder 14 for forwarding the sheets to the sheet guiding cylinder 3, and in a further, recto-verso operating mode, transfers sheets to a perfecting drum 15 for reversing and for forwarding to the sheet guiding cylinder 3.

According to a second embodiment, the perfecting system 8 can have a first transfer cylinder 13 and a perfecting drum 15 with a pincer gripper system 22 that can be switched between two operating modes. In the recto operating mode, the pincer gripper system 22 receives the leading edge of a respective sheet from the first transfer cylinder 13 and transfers it to the sheet guiding cylinder 3. In the recto-verso operating mode, the pincer gripper system 22 receives the trailing edge of a respective sheet from the first transfer cylinder 13 and transfers it to the sheet guiding cylinder 3, where it becomes the leading edge.

A primer unit 5 and/or a finish coating unit 6 is/are preferably assigned to the sheet guiding cylinder 3. Primer unit 5 and/or finish coating unit 6 may be constructed in a manner known per se and may have a primer metering system or a finish-coating metering system having an anilox roller and a chamber doctor blade, along with one or more transfer rollers.

The finish coating unit 6 may have a finish-coating forme cylinder. The primer unit 5 can likewise be configured as a flexo printing unit.

One or more dryers 7, which may be configured as infrared dryers and/or as thermal air dryers, are preferably assigned to the first sheet guiding system 12. Viewed in the direction of rotation of the sheet guiding cylinder 3, which is also the sheet transport direction of the sheet guiding cylinder 3, the primer unit 5, according to an alternative form, is preferably arranged upstream of the digital printing system 4 and the finish coating unit 6 is preferably arranged downstream of the digital printing system 4. The primer unit 5 and the finish coating unit 6 can also be located downstream of the digital printing system 4, as viewed in the direction of rotation of the sheet guiding cylinder 3, in which case the primer unit 5 is located upstream of the finish coating unit 6.

Preferably, the finish coating unit 6 and/or the primer unit 5 is/are assigned to the sheet guiding cylinder 3 between the digital printing system 4 and the first sheet guiding system 12.

The finish coating unit 6 can also be assigned to the sheet guiding cylinder 3 between the digital printing system 4 and the first sheet guiding system 12, and the primer unit 5 can be assigned to the sheet guiding cylinder 3 between the second sheet guiding system 8 and the digital printing system 4.

The delivery 11 preferably includes a chain conveyor system, generally at 18. It can have chains that circulate on rear and front sprockets. On the chains, gripper devices are preferably arranged, which gripper devices circulate with the chains and are also referred to as gripper bars. Similarly to the feeder 1, the delivery 11 preferably also has a pile board that is suspended from chains and can be displaced vertically by means of a pile lifting drive, and on which a pile carrier, in particular configured as a pallet, can be positioned. The pile carrier can accommodate one pile of sheets that are printed on one side, that are partially printed, or that are printed on both sides.

The delivery 11 is preferably located beside the feeder 1. The sheet guiding cylinder 3 and the first sheet guiding system 12 can be arranged above the feeder 1 and/or the delivery 11. This gives the sheet-fed printing press a highly compact construction.

With the described embodiments, a single sheet guiding cylinder 3 can be used for priming (precoating), printing, and finish coating. In addition, it is possible for the drying process of all process stages to be carried out within a small overall space. Switchable sheet transfers between the elements, in particular between the sheet guiding cylinder 3 and the first and the second sheet guiding systems 12, 8, allow different production variants to be carried out in any combination, e.g. simplex or duplex, priming or not priming, and finish coating or not finish coating. Rather than a single sheet guiding cylinder 3, multiple sheet guiding cylinders 3 can also be arranged in a row and preferably can be connected to one another via a transfer drum configured for sheet transport. In this embodiment, a digital printing system 4 is preferably assigned to each of the sheet guiding cylinders 3. A primer unit 5 and/or a finish coating unit 6 can also be assigned to each of the sheet guiding cylinders 3. In the configuration involving such multiple sheet guiding cylinders 3 that are connected to one another via a transfer drum, the first sheet guiding system 12 connects the last sheet guiding cylinder 3 to the first sheet guiding cylinder such that the first sheet guiding system is configured to remove sheets from the lateral surface of the last sheet guiding cylinder 3 and to feed the same sheets to the lateral surface of the first sheet guiding cylinder 3. In that case, a second sheet guiding system 8, preferably configured as a perfecting system 8, can be provided between the first sheet guiding system 12 and the first sheet guiding cylinder 3.

While a preferred embodiment of a sheet-fed printing press, in accordance with the present invention, has been set forth fully and completely herein above, it will be apparent to one of skill in the art that various changes could be made hereto, without departing from the true spirit and scope of the present invention, which is accordingly to be limited only by the appended claims.

The invention claimed is:

1. A sheet-fed printing press having a feeder, a delivery, at least one sheet guiding cylinder, which at least one sheet guiding cylinder is located between the feeder and the delivery, and which has at least one gripper system, and a digital printing system, the sheet-fed printing press further having a first sheet guiding system for removing sheets from the at least one sheet guiding cylinder, wherein the first sheet guiding system is configured for one of transferring the sheets to a second sheet guiding system, which second sheet guiding system transfers the sheets to the at least one sheet guiding cylinder, and transferring the sheets to the delivery, wherein the second sheet guiding system is configured as a perfecting system and is switchable between a first perfecting system operating mode, in which the second sheet guiding system feeds the sheets, in a reversed position, to the at least one sheet guiding cylinder and a second perfecting system operating mode, in which the second sheet guiding system feeds the sheets, in a non-reversed position, to the at least one sheet guiding cylinder, wherein the first sheet guiding system is configured as a chain conveyor system and one of wherein at least one dryer is assigned to the chain conveyor system, and wherein the perfecting system has a first transfer cylinder, a second transfer cylinder and a perfecting drum, wherein the first transfer cylinder, in a first transfer cylinder operating mode, transfers sheets to the second transfer cylinder and wherein, in a second transfer cylinder operating mode, the first transfer cylinder transfers sheets to the perfecting drum.

2. The sheet-fed printing press according to claim 1, wherein the perfecting drum has a pincer gripper system, which pincer gripper system is switchable between first and second pincer gripper system operating modes, wherein, in the first pincer gripper system operating mode, the pincer gripper system receives a leading edge of a respective sheet from the first transfer cylinder and wherein, in the second pincer gripper system operating mode, the pincer gripper system receives a trailing edge of a respective sheet from the first transfer cylinder.

3. The sheet-fed printing press according to claim 1, wherein the sheet-fed printing press includes at least one of a primer unit and a finish coating unit assigned to the at least one sheet guiding cylinder.

4. The sheet-fed printing press according to claim 1, wherein the at least one dryer is configured as one of an infrared dryer and as a thermal air dryer.

5. The sheet-fed printing press according to claim 1, wherein the feeder is arranged beside the delivery.

6. The sheet-fed printing press according to claim 1, wherein the at least one sheet guiding cylinder and the first sheet guiding system are located above one of the feeder and the delivery.

7. The sheet-fed printing press according to claim 1, wherein the at least one sheet guiding cylinder is configured as one of a single, a double, a triple and a quadruple circumference cylinder and has at least one gripper system for securing the leading edges of the sheets and has at least one holding system for securing the sheets, in a region of the sheets that is spaced apart from leading edges of the sheets.

8. The sheet-fed printing press according to claim 1, wherein the at least one sheet guiding cylinder has an even number of gripper systems for securing leading edges of the sheets, wherein a lateral region of the at least one sheet guiding cylinder, and configured as a sheet guiding surface, adjoins each such gripper system, wherein at least one such sheet guiding surface is closed, and wherein at least one such sheet guiding surface has openings, to which sheet gripper guiding surface openings suction air is applied.

9. A sheet-fed printing press having a feeder, a delivery, and at least one sheet guiding cylinder, which at least one sheet guiding cylinder is located between the feeder and the delivery, has at least one gripper system, and is assigned a digital printing system, the sheet-fed printing press having a first sheet guiding system for removing sheets from the at least one sheet guiding cylinder, wherein the first sheet guiding system is configured for one of transferring the sheets to a second sheet guiding system, which second sheet guiding system transfers the sheets to the at least one sheet guiding cylinder, and transferring the sheets to the delivery, wherein the first sheet guiding system encompasses the at least one sheet guiding cylinder in a circumferential area that is greater than 180 degrees, and which first sheet guiding system is configured as a chain conveyor system, wherein at least one dryer, configured as one of an infrared dryer and/or as a thermal air dryer, is assigned to the chain conveyor system of the first sheet guiding system, and wherein the second sheet guiding system is configured as a perfecting system and is switchable between a first perfecting system operating mode, in which the second sheet guiding system feeds the sheets, in a reversed position, to the at least one sheet guiding cylinder and a second perfecting system operating mode, in which the second sheet guiding system feeds the sheets, in a non-reversed position, to the at least one sheet guiding cylinder.

10. The sheet-fed printing press according to claim 9, wherein the sheet-fed printing press includes one of a primer unit and a finish coating unit assigned to the at least one sheet guiding cylinder.

11. The sheet-fed printing press according to claim 9, wherein the feeder is arranged beside the delivery.

12. The sheet-fed printing press according to claim 9, wherein the at least one sheet guiding cylinder and the first sheet guiding system are arranged above the one of the feeder and the delivery.

13. The sheet-fed printing press according to claim 9, wherein the at least one sheet guiding cylinder is configured as one of a single and a double and a triple and a quadruple circumference cylinder and has at least one gripper system for securing leading edges of the sheets and has at least one holding system for securing the sheets in a region of the sheets that is spaced apart from leading edges of the sheets.

14. The sheet-fed printing press according to claim 9, wherein the at least one sheet guiding cylinder has an even number of gripper systems for securing leading edges of the sheets, wherein a lateral region of the at least one sheet guiding cylinder, and configured as a sheet guiding surface, adjoins each such gripper system, wherein at least one such sheet guiding surface is closed, and wherein at least one such sheet guiding surface has openings, to which sheet gripper guiding surface openings suction air is applied.

* * * * *